US011214457B2

(12) United States Patent
Yraceburu et al.

(10) Patent No.: US 11,214,457 B2
(45) Date of Patent: Jan. 4, 2022

(54) MEDIA PULLER BARRIER DEVICES

(71) Applicant: Hewlett-Packard Development Company, L.P., Spring, TX (US)

(72) Inventors: Robert Yraceburu, Vancouver, WA (US); Arturo Ayala, Vancouver, WA (US); Elliott Downing, Vancouver, WA (US); Matthew Douglas Reier, Vancouver, WA (US); Gene Jones, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/645,044

(22) PCT Filed: Sep. 15, 2017

(86) PCT No.: PCT/US2017/051894
§ 371 (c)(1),
(2) Date: Mar. 6, 2020

(87) PCT Pub. No.: WO2019/055031
PCT Pub. Date: Mar. 21, 2019

(65) Prior Publication Data

US 2020/0189871 A1 Jun. 18, 2020

(51) Int. Cl.
*B65H 29/04* (2006.01)

(52) U.S. Cl.
CPC ..... *B65H 29/041* (2013.01); *B65H 2404/231* (2013.01); *B65H 2801/24* (2013.01)

(58) Field of Classification Search
CPC ..... B65H 29/02; B65H 29/04; B65H 29/003; B65H 29/005; B65H 29/041; B65H 2404/231; B65H 29/045; B65H 29/047; B65H 29/048; B65H 2801/24
See application file for complete search history.

(56) References Cited

U.S. PATENT DOCUMENTS

| | | | | |
|---|---|---|---|---|
| 4,981,380 | A | 1/1991 | Nishida | |
| 5,288,062 | A | 2/1994 | Rizzolo et al. | |
| 5,456,544 | A | 10/1995 | Aoki | |
| 6,550,758 | B2 | 4/2003 | Ardery et al. | |
| 7,530,567 | B2 | 5/2009 | Bober et al. | |
| 8,550,461 | B2 * | 10/2013 | Sekigawa | B65H 39/115 271/277 |
| 8,588,675 | B2 | 11/2013 | Onodera | |
| 9,346,643 | B2 | 5/2016 | Ito | |
| 2015/0049150 | A1 | 2/2015 | Muench | |
| 2016/0363907 | A1 | 12/2016 | Enomoto et al. | |

FOREIGN PATENT DOCUMENTS

WO WO2017099762 A1 6/2017

* cited by examiner

*Primary Examiner* — Thomas A Morrison
(74) *Attorney, Agent, or Firm* — Brooks Cameron & Huebsch PLLP

(57) ABSTRACT

In one example, a media puller device can include a snowplow device coupled to a first end of a hinge, a leading end of the media puller device coupled to a second end of the hinge, and a tension device coupled between the snowplow device and the media puller device.

18 Claims, 6 Drawing Sheets

MEDIA PULLER BARRIER DEVICES

BACKGROUND

Inkjet printers can deposit quantities of printing fluid onto a printable media (e.g., paper, plastic, etc.). In some examples, inkjet printers can create a curl and/or cockle in the printed media when the printing fluid droplets are deposited by the inkjet printer. In some examples, a number of physical properties of the printable media can be changed when the printing fluid droplets are deposited by the inkjet printer. For example, the stiffness of the printable media can be changed when the printing fluid droplets are deposited by the inkjet printer. The curl, cockle, and/or other physical properties that change due to the printing fluid droplets can make document finishing processes difficult.

DETAILED DESCRIPTION

Figure 1:
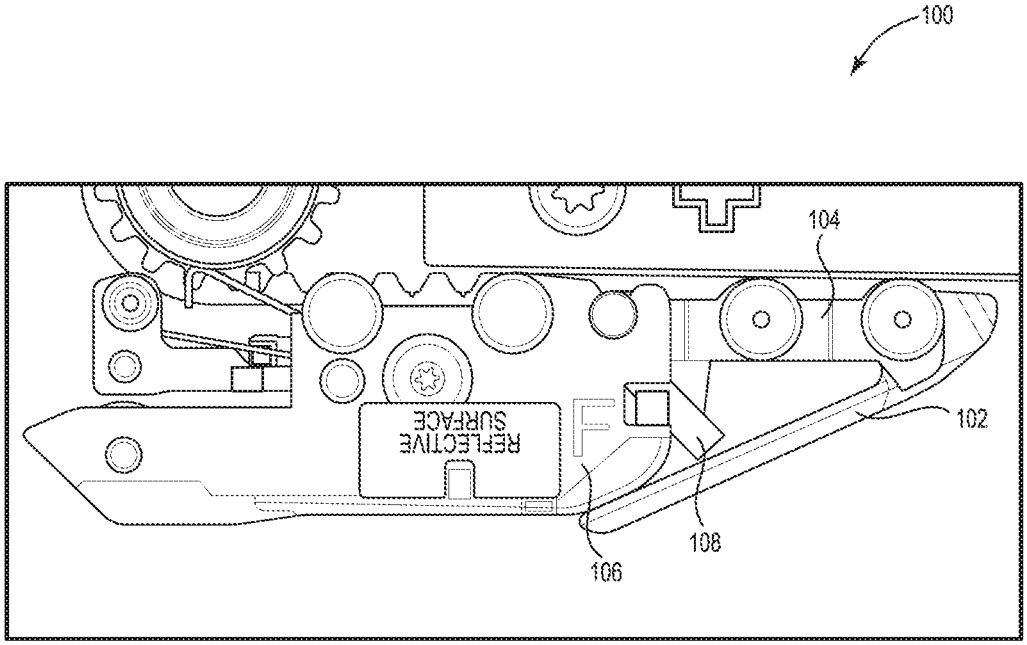
FIG. 1 illustrates an example media puller device consistent with the present disclosure.

A number of systems and devices for a media puller snowplow are described herein. In one example, a media puller device can include a snowplow device coupled to a first end of a hinge, a leading end of the media puller device coupled to a second end of the hinge, and a tension device coupled between the snowplow device and the media puller device. In some examples, a system for a puller device can include a continuous track, a media puller device coupled to the continuous track, a snowplow device coupled to a first link, a leading end of the media puller device coupled to a second link that is coupled to the first link, and a tension device coupled between the snowplow device and the media puller device.

In some examples, a finisher can include a continuous track to move a media puller device from a first end of the finisher to a second end of the finisher, the media puller device to receive print media at the first end of the finisher and deliver the print media to the second end of the finisher via the continuous track, and a snowplow device coupled to a leading end of the media puller via a first link and a second link that are connected at a rotating joint. In some examples, the finisher can be utilized to stack partially dried inkjet media. For example, the finisher can be part of an inkjet printing device that can be utilized to stack and perform a finishing process (e.g., stapling, collating, hole punching, etc.).

The inkjet printing device can include a print zone to deposit a printing fluid on a print media. The print zone of the inkjet printing device can deposit the printing fluid to generate partially dried inkjet media. In some examples, the partially dried inkjet media can provide difficulties when stacking, aligning, and/or finishing. For example, the partially dried inkjet media can have distorted properties such as a curl, a cockle, a reduction in stiffness, increased surface roughness, extruding or protruding fibers from the surface, misaligned fibers, and/or increased sheet to sheet friction of the media. In some examples, these distorted properties can be caused by printing fluid deposited on the media and the media absorbing the printing fluid. For example, the printing fluid can be in a liquid state that can be absorbed by a media such as paper. In this example, the liquid state of the printing fluid can cause the distorted properties of the media in a similar way that other liquids may distort the properties of the media.

As described herein, the finisher can be utilized to stack partially dried inkjet media. The finisher can include a media puller to receive partially dried inkjet media from the print zone and move the media from a first side of the finisher to a second side of the finisher for stacking the partially dried inkjet media. In some examples, the media puller can include a media puller snowplow device to interact with stacked partially dried inkjet media. For example, the media puller can pass over the stacked partially dried inkjet media and the media puller snowplow can prevent the media puller from hitting or interacting with the partially dried inkjet media in a way that can damage the partially dried inkjet media. The media puller snowplow described herein can utilize a plurality of links to allow the media puller snowplow to more easily move around corners of a continuous track and reduce a space occupied by the media puller snowplow when the media puller is moving around the corners of the continuous track.

The figures herein follow a numbering convention in which the first digit corresponds to the drawing figure number and the remaining digits identify an element or component in the drawing. Elements shown in the various figures herein may be capable of being added, exchanged, and/or eliminated to provide a number of additional examples of the present disclosure. In addition, the proportion and the relative scale of the elements provided in the figures are intended to illustrate the examples of the present disclosure, and should not be taken in a limiting sense.

FIG. 1 illustrates an example media puller device 106 consistent with the present disclosure. FIG. 1 can illustrate a system 100 that includes a media puller device 106. The system 100 can be part of a finisher device of a printing device. For example, the system 100 can be part of a finisher device of an inkjet printing device as described herein.

In some examples, the media puller device 106 can move print media such as partially dried inkjet media from a first end of the finisher device to a second end of the finisher device. For example, the media puller device 106 can move partially dried inkjet media from an output of a print zone to a stacking area of the finisher device such that a stack of partially dried inkjet media can be formed on the second end of the finisher device. In some examples, a snowplow device 102 can be utilized to interact with the stack of print media when the media puller device 106 is moving the print media from the first end to the second end of the finisher device. For example, the snowplow device 102 can be in contact with the stack of print media to prevent the print media from being damaged by the media puller device 106.

In some examples, a media puller device 106 can include a snowplow device 102 coupled to a first end of a hinge 104, a leading end of the media puller device 106 coupled to a second end of the hinge 104, and a tension device 108 coupled between the snowplow device 102 and the media puller device 106. In some examples, the media puller device 106 can include a clamp to receive and move the print media from a first end of the system 100 to a second end of the system 100. For example, the clamp can be positioned on an opposite side from the snowplow device 102. In this example, the snowplow device 102 can be positioned on a right side of the system 100 as illustrated in FIG. 1 and the clamp can be positioned on a left side of the system 100 as illustrated in FIG. 1.

In some examples, the media puller device 106 can transport or move print media from a left side of the system 100 to a right side of the system 100 as illustrated in FIG. 1. For example, the media puller device 106 can move from the left side of the system 100 to the right side of the system 100 when the media puller device 106 is moving print media. Thus, the snowplow device 102 can be at a leading end of the media puller device 106. Having the snowplow device 102 be positioned at the leading end of the media puller device 106 can allow the snowplow device 102 to interact with a stack of print media positioned below the media puller device 106. Having the snowplow device 102 positioned at the leading end of the media puller device 106 can prevent the leading end of the media puller device 106 from disturbing or damaging a stack of print media positioned below the pathway of the media puller device 106.

In some examples, the snowplow device 102 can be coupled to a leading end of the media puller device by a hinge 104. In some examples, the hinge 104 can pivot to maintain an angle of the snowplow device 102 when the media puller device 106 is positioned at a plurality of locations on a continuous track. For example, the hinge 104 can pivot around corners of the continuous track to maintain an angle of the snowplow device 102 when the media puller device 106 moves around the corner of the continuous track.

In some examples, the hinge 104 can pivot around corners of the continuous track to reduce a swept volume of the media puller device 106, the hinge 104, and the snowplow device 102. In some examples, the snowplow device 102 can be within a swept volume of the media puller device 106 when the media puller device 106 is positioned at a corner of a continuous track. As used herein, the swept volume of the media puller device 106 can be a circumference of an area occupied by the media puller device 106. In some examples, the swept volume of the media puller device 106 and/or the snowplow device 102 can increase when the media puller device 106 is moving around a corner of the continuous track. Thus, the hinge 104 can be utilized to maintain or reduce a swept volume of the media puller device 106 and the snowplow device 102 as the media puller device 106 and snowplow device 102 moves around a corner of the continuous track. In some examples, limited space surrounding the continuous track and/or the media puller device 106 can limit a usable swept volume around the corners of the continuous track.

In some examples, the system 100 can include a tension device 108 to maintain an angle of the snowplow device 102 while the media puller device 106 is moving by biasing the snowplow device 102 against the media puller device 106. In some examples, the tension device 108 can be a spring coupled between snowplow device and the media puller device 106. In other examples, a torsion spring can be mounted to the hinge 104 to provide biasing. In some examples, the tension device 108 can prevent the snowplow device 102 from extending beyond a particular swept volume. For example, the tension device 108 can be a spring that prevents the snowplow device 102 from deviating from a particular snowplow angle. As used herein, a snowplow angle can be an angle between the hinge 104 and the surface of the snowplow device 102. In some examples, the hinge 104 can pivot around corners of the continuous track to maintain the angle between a media stacking plane and the snowplow device 102. As used herein, a media stacking plane can be a surface level of a stack of print media in a stacking area of the finisher device.

In some examples, the hinge 104 can include a plurality of links coupled together to maintain an angle between a media stacking plane and the snowplow device 102 when the media puller device 106 is positioned at a corner of a continuous track. As described herein, the hinge 104 can pivot around corners of the continuous track to maintain the angle between the hinge 104 and the surface of the snowplow device 102. In some examples, the hinge 104 can pivot around corners of the continuous track to maintain the angle between a media stacking plane and the snowplow device 102. The plurality of links can provide multiple pivot points between the media puller device 106 and the snowplow device 102. The multiple pivot points of the plurality of links can reduce the swept volume of the snowplow device 102 as the media puller device 106 moves around a corner of the continuous track. In some examples, the hinge 104 can include a first link that is coupled to a leading end of the media puller device 106 and a second link that is coupled to the snowplow device 102. In some examples, the first link can be coupled to the second link by a rotating joint (e.g., rotating pin, pin, etc.) to allow the hinge 104 to rotate at the connection of the second link and the leading end of the media puller device 106, the connection of the first link and the second link, and the connection of the first link to the snowplow device 102. That is, there can be a plurality of pivot points provided by the hinge 104.

In some examples, the media puller device 106 can include a first hard stop to prevent the tension device 108 from being overstretched and a second hard stop to provide tension on the tension device 108. In some examples, the first hard stop can be positioned on a first link of the hinge 104 to interact with a first side of the snowplow device 102. For example, the hinge 104 can include a first link that includes a first hard stop to interact with a portion of the snowplow device 102 that is positioned next to a rotating joint that couples the hinge 104 to the snowplow device 102. In some examples, the second hard stop can be positioned on a second link of the hinge 104 to interact with a second portion of the snowplow device 102. For example, the second link of the hinge 104 can include an extended portion to interact with an interior portion of the snowplow device 102 to provide tension on the tension device 108. Further examples, of the first hard stop and second hard stop are referenced further in FIG. 4 and FIG. 5.

The system 100 can provide a snowplow device 102 that can more easily move around corners without extending a swept volume of the media puller device 106 when the media puller device 106 moves around a corner of a continuous track. In some examples, the snowplow device 102 can be coupled to a hinge 104 that is coupled to the media puller device 106 to provide pivot points that allow the snowplow device 102 to maintain an angle and reduce the swept volume compared to previous devices and systems.

Figure 2:
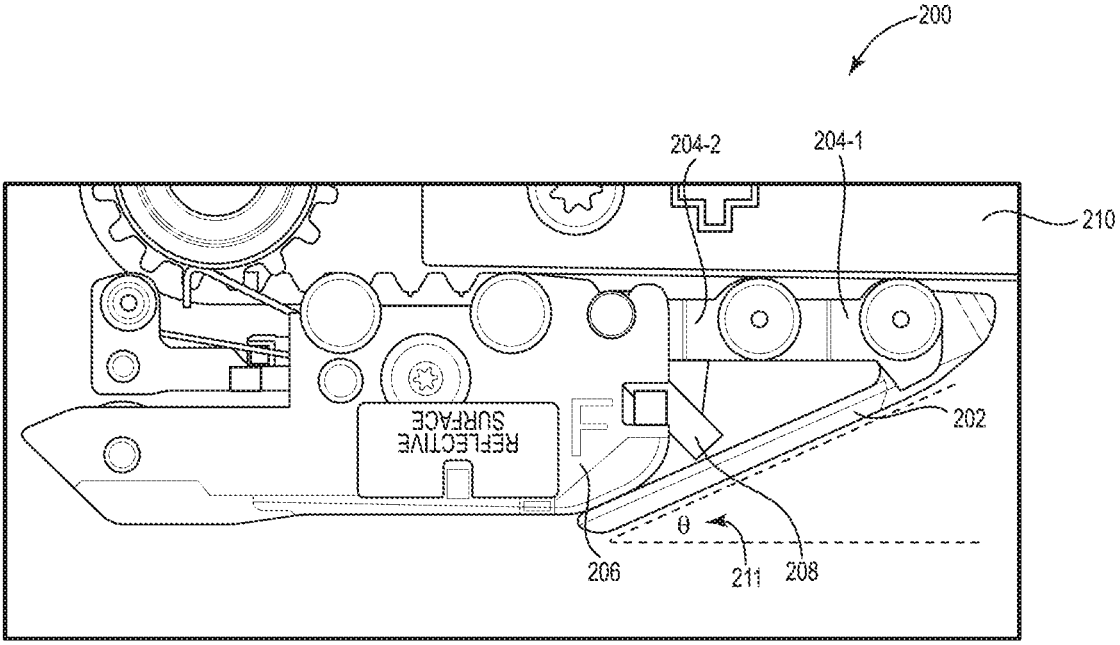
FIG. 2 illustrates an example system for a media puller snowplow consistent with the present disclosure.

FIG. 2 illustrates an example system 200 for a media puller snowplow consistent with the present disclosure. The system 200 can be part of a finisher device of a printing device. For example, the system 200 can be part of a finisher device of an inkjet printing device as described herein.

In some examples, the media puller device 206 can move print media such as partially dried inkjet media from a first end of the finisher device to a second end of the finisher device. For example, the media puller device 206 can move partially dried inkjet media from an output of a print zone to a stacking area of the finisher device such that a stack of partially dried inkjet media can be formed on the second end of the finisher device. In some examples, a snowplow device 202 can be utilized to interact with the stack of print media when the media puller device 206 is moving the print media from the first end to the second end of the finisher device. For example, the snowplow device 202 can be in contact with the stack of print media to prevent the print media from being damaged by the media puller device 206.

In some examples, a system 200 for a puller device 206 can include a continuous track 210, a media puller device 206 coupled to the continuous track 206, a snowplow device 202 coupled to a first link 204-1, a leading end of the media puller device 206 coupled to a second link 204-2 that is coupled to the first link 204-1, and a tension device 208 coupled between the snowplow device 202 and the media puller device 206.

In some examples, the media puller device 206 can transport or move print media from a left side of the system 200 to a right side of the system 200 as illustrated in FIG. 2. For example, the media puller device 206 can move from the left side of the system 200 to the right side of the system 200 when the media puller device 206 is moving print media. Thus, the snowplow device 202 can be at a leading end of the media puller device 206. Having the snowplow device 202 be positioned at the leading end of the media puller device 206 can allow the snowplow device 202 to interact with a stack of print media positioned below the media puller device 206. Having the snowplow device 202 positioned at the leading end of the media puller device 206 can prevent the leading end of the media puller device 206 from disturbing or damaging a stack of print media positioned below the pathway of the media puller device 206. As used herein, a leading end or leading edge of the media puller device 206 is an end that is positioned in front when the media puller device 206 is moving print media on the continuous track 210. That is, in FIG. 2, a right end of the media puller device 206 is the leading end of the media puller device 206 when the media puller device 206 is moving from left to right as illustrated in FIG. 2.

In some examples, the snowplow device 202 can be coupled to a leading end of the media puller device 206 by a first link 204-1 and a second link 204-2. In some examples, the first link 204-1 and the second link 204-2 can pivot to maintain an angle 211 of the snowplow device 202 when the media puller device 206 is positioned at a plurality of locations on a continuous track 210. For example, the first link 204-1 and the second link 204-2 can pivot around corners of the continuous track 210 to maintain an angle 211 of the snowplow device 202 when the media puller device 206 moves around the corner of the continuous track 210.

In some examples, the first link 204-1 and the second link 204-2 can pivot around corners of the continuous track 210 to reduce a swept volume of the media puller device 206 and the snowplow device 202. In some examples, the snowplow device 202 can be within a swept volume of the media puller device 206 when the media puller device 206 is positioned at a corner of a continuous track 210. As used herein, the swept volume of the media puller device 206 can be a circumference of an area occupied by the media puller device 206. In some examples, the swept volume of the media puller device 206 and the snowplow device 202 can increase when the media puller device 206 is moving around a corner of the continuous track 210. Thus, the first link 204-1 and the second link 204-2 can be utilized to maintain or reduce a swept volume of the media puller device 206 and the snowplow device 202 as the media puller device 206 and snowplow device 202 moves around a corner of the continuous track 210. In some examples, limited space surrounding the continuous track 210 and/or the media puller device 206 can limit a usable swept volume around the corners of the continuous track 210.

In some examples, the system 200 can include a tension device 208 to maintain an angle 211 of the snowplow device 202 by biasing the snowplow device 202 against the media puller device 206 while the media puller device 206 is moving. In some examples, the tension device 208 can prevent the snowplow device 202 from extending beyond a particular swept volume. For example, the tension device 208 can be a spring that prevents the snowplow device 202 from deviating from a particular snowplow angle 211. As used herein, a snowplow angle can be an angle 211 between the surface of the snowplow device 202 and a bottom portion of the media puller device 206.

In some examples, the plurality of links 204-1, 204-2 can be coupled together to maintain an angle 211 between a media stacking plane and the snowplow device 202 when the media puller device 206 is positioned at a corner of a continuous track 210. As described herein, the first link 204-1 and the second link 204-2 can pivot around corners of the continuous track 210 to maintain the angle 211 between a media stacking plane and the snowplow device 202. The plurality of links 204-1, 204-2 can provide multiple pivot points between the media puller device 206 and the snowplow device 202. The multiple pivot points of the plurality of links 204-1, 204-3 can reduce the swept volume of the snowplow device 202 as the media puller device 206 moves around a corner of the continuous track 210. In some examples, system 200 can include a first link 204-1 that is coupled to a leading end of the media puller device 206 and a second link 204-2 that is coupled to the snowplow device 202. In some examples, the first link 204-1 can be coupled to the second link 204-2 by a rotating joint to allow the first link 204-1 and the second link 204-2 to rotate at the connection of the second link 204-2 and the leading end of the media puller device 206, the connection of the first link 204-1 and the second link 204-2, and the connection of the first link 204-1 to the snowplow device 202. That is, there can be a plurality of pivot points provided by the first link 204-1 and the second link 204-2.

In some examples, the system 200 can include a hard stop coupled to the second link 204-2 to maintain a tension on the tension device 208 when the media puller device 206 is positioned at a corner of the continuous track 210. As described herein, the second link 204-2 can include an extended portion to interact with an interior side (e.g., left side of snowplow device 202 as illustrated in FIG. 2) of the snowplow device 202 to maintain tension on the tension device 208. Without the hard stop of the second link 204-2 the tension device 208 may not be providing any tension on the snowplow device 202.

In some examples, the system 200 can include a hard stop coupled to the first link 204-1 to prevent over-rotation of the snowplow device 202. As described herein, the first link 204-1 can include a protrusion near the connection between the first link 204-1 and the snowplow device 202 to interact with a protrusion of the snowplow device 202. In some examples, the hard stop coupled to the first link 204-1 can prevent the snowplow device 202 from overextending the tension device 208 and/or extending beyond a particular swept volume. In some examples, preventing the snowplow device 202 from overextension can prevent damage to the tension device 208 and/or prevent the snowplow device from interacting with objects that are outside a usable swept volume for the system 200.

In some examples, the snowplow device 202 can prevent stacked media from being damaged when interacting with the media puller device 206. As described herein, the media puller device 206 can move print media to a stacking area that includes a stack of print media. In some examples, the stack of print media can be positioned below the pathway of the media puller device. In these examples, the media puller device 206 can travel over the stack of print media. In some examples, the angle 211 of the snowplow device 202 can prevent the stack of print media from being disturbed or damaged by the media puller device 206.

In some examples, an angle 211 between a media stacking plane and the snowplow device 202 can be less than 30 degrees despite a position of the media puller device on the continuous track 210. As described herein, the angle 211 of the snowplow device 202 can push the stack of print media downward and away from the media puller device 206. In some examples, the angle 211 can be less than 30 degrees when the media puller device 206 and the snowplow device are positioned at a corner of the continuous track 210.

In some examples, a tip of the snowplow device 202 is positioned between a front and rear halves of the continuous track 210 when the media puller device is positioned at a corner of the continuous track 210. As illustrated further in FIG. 4 and FIG. 5, the tip of the snowplow device 202 can be a leading tip of the snow plow device 202 positioned to the far right of the system 200 as illustrated in FIG. 2. In some examples, the tip of the snowplow device 202 can be shaped and positioned to pivot such that the tip of the snowplow device 202 does not extend beyond a particular swept volume.

The system 200 can provide a snowplow device 202 that can more easily move around corners of a continuous track 210 without extending a swept volume of the media puller device 206 when the media puller device 206 moves around a corner of a continuous track 210. In some examples, the snowplow device 202 can be coupled to a first link 204-1 and a second link 204-2 that are coupled to the media puller device 206 to provide pivot points that allow the snowplow device 202 to maintain an angle 211 and reduce the swept volume compared to previous devices and systems.

Figure 3:
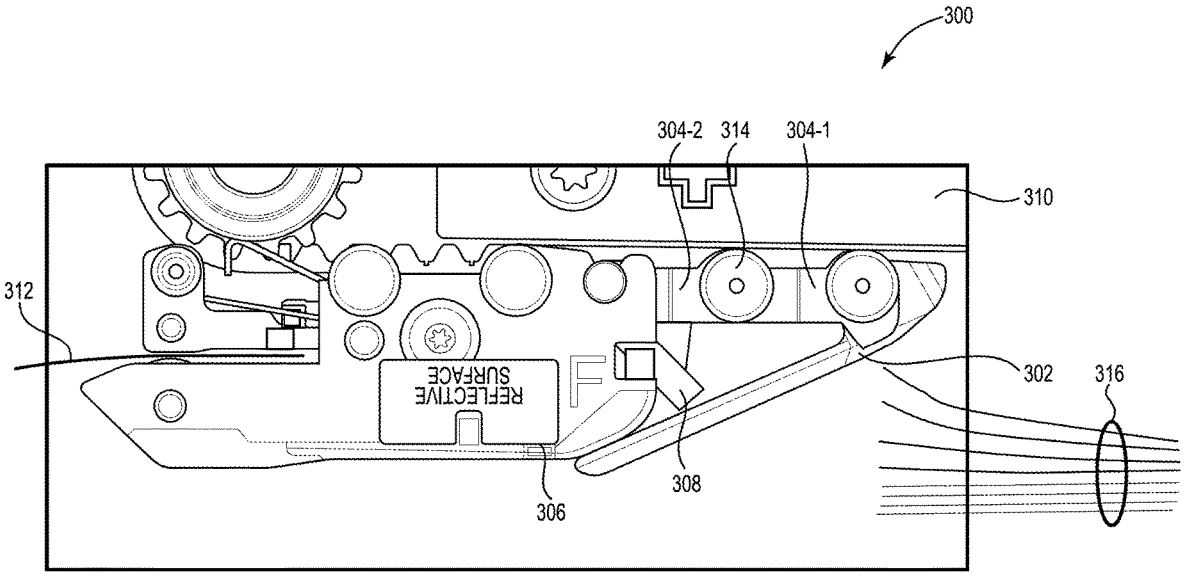
FIG. 3 illustrates an example finisher that includes a media puller snowplow consistent with the present disclosure.

FIG. 3 illustrates an example finisher that includes a media puller snowplow consistent with the present disclosure. The system 300 can be part of a finisher device of a printing device. For example, the system 300 can be part of a finisher device of an inkjet printing device as described herein.

In some examples, the media puller device 306 can move print media 312 such as partially dried inkjet media from a first end of the finisher device to a second end of the finisher device. For example, the media puller device 306 can move partially dried inkjet media from an output of a print zone to a stacking area of the finisher device such that a stack 316 of partially dried inkjet media can be formed on the second end of the finisher device. In some examples, a snowplow device 302 can be utilized to interact with the stack 316 of print media when the media puller device 306 is moving the print media 312 from the first end to the second end of the finisher device. For example, the snowplow device 302 can be in contact with the stack 316 of print media to prevent the stack 316 of print media from being damaged by the media puller device 306.

In some examples, a finisher can include a continuous track 310 to move a media puller device 306 from a first end of the finisher to a second end of the finisher, the media puller device 306 to receive print media 312 at the first end of the finisher and deliver the print media 312 to the second end of the finisher via the continuous track 310, and a snowplow device 302 coupled to a leading end of the media puller device 306 via a first link 304-1 and a second link 304-2 that are connected at a rotating joint 314.

In some examples, the media puller device 306 can transport or move print media 312 from a left side of the system 300 to a right side of the system 300 as illustrated in FIG. 3. For example, the media puller device 306 can move from the left side of the system 300 to the right side of the system 300 when the media puller device 306 is moving print media 312. Thus, the snowplow device 302 can be at a leading end of the media puller device 306 and the print media 312 can be at a trailing end of the media puller device 306. Having the snowplow device 302 be positioned at the leading end of the media puller device 306 can allow the snowplow device 302 to interact with a stack 316 of print media positioned below the media puller device 306. Having the snowplow device 302 positioned at the leading end of the media puller device 306 can prevent the leading end of the media puller device 306 from disturbing or damaging a stack 316 of print media positioned below the pathway of the media puller device 306. As used herein, a leading end or leading edge of the media puller device 306 is an end that is positioned in front when the media puller device 306 is moving print media 312 on the continuous track 310. That is, in FIG. 3, a right end of the media puller device 306 is the leading end of the media puller device 306 when the media puller device 306 is moving from left to right as illustrated in FIG. 3.

In some examples, the snowplow device 302 can be coupled to a leading end of the media puller device 306 by a first link 304-1 and a second link 304-2. In some examples, the first link 304-1 and the second link 304-2 can pivot to maintain an angle of the snowplow device 302 when the media puller device 306 is positioned at a plurality of locations on a continuous track 310. For example, the first link 304-1 and the second link 304-2 can pivot at a joint 314 around corners of the continuous track 310 to maintain an angle of the snowplow device 302 when the media puller device 306 moves around the corner of the continuous track 310.

In some examples, the first link 304-1 and the second link 304-2 can pivot around corners of the continuous track 310 to reduce a swept volume of the media puller device 306 and the snowplow device 302. In some examples, the snowplow device 302 can be within a swept volume of the media puller device 306 when the media puller device 306 is positioned at a corner of a continuous track 310. As used herein, the swept volume of the media puller device 306 and the snowplow device 302 can be a circumference of an area occupied by the media puller device 306 and the snowplow device 302. In some examples, the swept volume of the media puller device 306 and the snowplow device 302 can increase when the media puller device 306 and the snowplow device 302 are moving around a corner of the continuous track 310. Thus, the first link 304-1 and the second link 304-2 can be utilized to maintain or reduce a swept volume of the media puller device 306 as the media puller device 306 moves around a corner of the continuous track 310. In some examples, limited space surrounding the continuous track 310 and/or the media puller device 306 can limit a usable swept volume around the corners of the continuous track 310.

In some examples, the system 300 can include a tension device 308 to maintain an angle of the snowplow device 302 by biasing the snowplow device 302 against the media puller device 306 while the media puller device 306 is moving. In some examples, the tension device 308 can prevent the snowplow device 302 from extending beyond a particular swept volume. For example, the tension device 308 can be a spring that prevents the snowplow device 302 from deviating from a particular snowplow angle. As used herein, a snowplow angle can be an angle between the first link 304-1 and the second link 304-2 and the surface of the snowplow device 302.

In some examples, the plurality of links 304-1, 304-2 can be coupled together to maintain an angle between a media stacking plane and the snowplow device 302 when the media puller device 326 is positioned at a corner of a continuous track 310. As described herein, the first link 304-1 and the second link 304-2 can pivot around corners of the continuous track 310 to maintain the angle between a media stacking plane of the stack 316 of print media and the snowplow device 302. The plurality of links 304-1, 304-2 can provide multiple pivot points (e.g., joint 314, etc.) between the media puller device 306 and the snowplow device 302. The multiple pivot points of the plurality of links 304-1, 304-2 can reduce the swept volume of the snowplow device 302 as the media puller device 306 moves around a corner of the continuous track 310. In some examples, the system 300 can include a first link 304-1 that is coupled to the snowplow device 302 and a second link 304-2 that is coupled to a leading end of the media puller device 306. In some examples, the first link 304-1 can be coupled to the second link 304-2 by a rotating joint 314 to allow the first link 304-1 and the second link 304-2 to rotate at the joint 314 of the second link 304-2. In addition, the second link 304-2 can be coupled to a joint of the leading end of the media puller device 306 to allow rotation between the second link 304-2 and the leading end of the media puller device 306. In addition, the connection of the first link 304-1 to the snowplow device 302 can be a rotating joint to allow rotation between the first link 304-1 and the snowplow device 302. That is, there can be a plurality of pivot points provided by the first link 304-1 and the second link 304-2.

In some examples, the snowplow device 302 can prevent a stack 316 of print media from being damaged when interacting with the media puller device 306. As described herein, the media puller device 306 can move print media 312 to a stacking area that includes a stack 316 of print media. In some examples, the stack 316 of print media can be positioned below the pathway of the media puller device 306. In these examples, the media puller device 306 can travel over the stack 316 of print media. In some examples, the angle of the snowplow device 302 can prevent the stack 316 of print media from being disturbed or damaged by the media puller device 306.

In some examples, the rotating joint 314 can include a bearing to provide a knuckle between the first link 304-1 and the second link 304-2. For example, the rotating joint 314 can include a pin through a slot or aperture. In this example, the slot or aperture can include a bearing (e.g., ball bearing, etc.) to reduce friction between the first link 304-1 and the second link 304-2.

In some examples, the media puller device can deliver the print media 312 to a print media stack 316 positioned below the media puller device 306. In some examples, the snowplow device 302 can prevent the print media stack 316 from interacting with the media puller device 306. The system 300 can provide a snowplow device 302 that can more easily move around corners of a continuous track 310 without extending a swept volume of the media puller device 306 when the media puller device 306 moves around a corner of a continuous track 310. In some examples, the snowplow device 302 can be coupled to a first link 304-1 and a second link 304-2 that are coupled to the media puller device 306 to provide pivot points that allow the snowplow device 302 to maintain an angle and reduce the swept volume compared to previous devices and systems.

Figure 4:
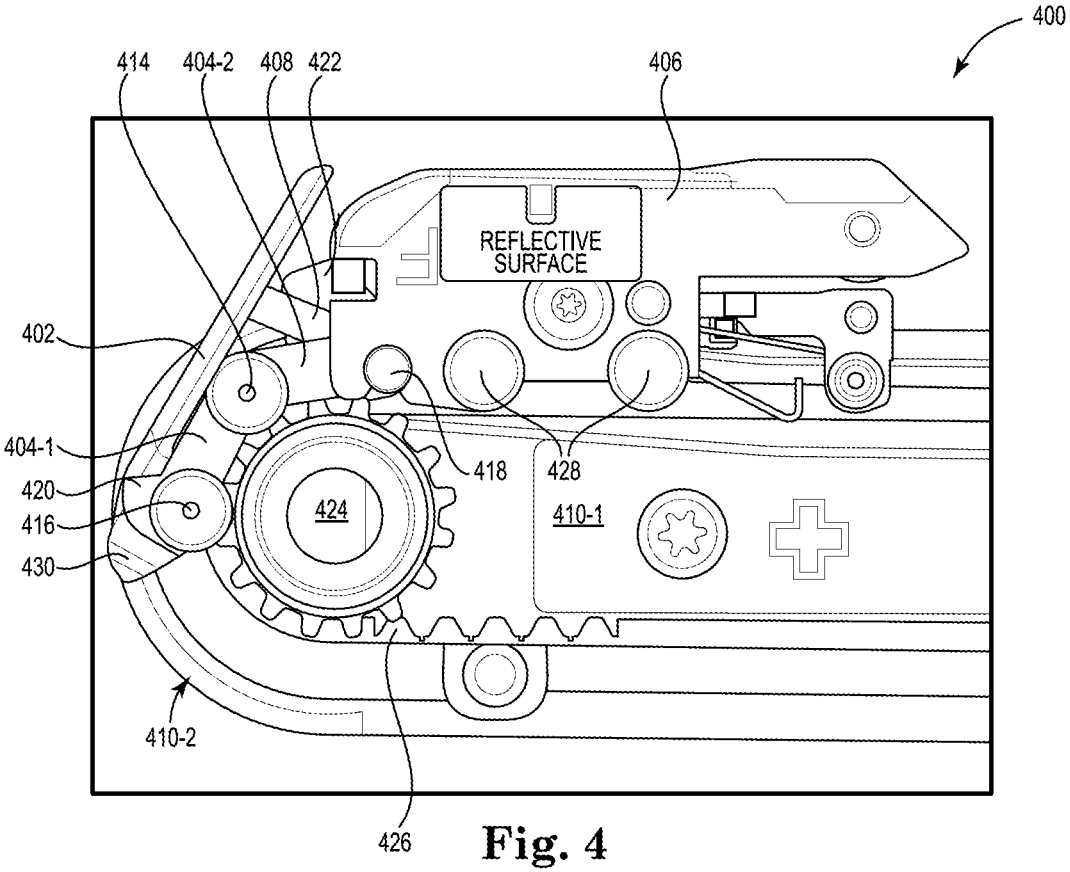
FIG. 4 illustrates an example media puller device consistent with the present disclosure.

FIG. 4 illustrates an example media puller device 406 consistent with the present disclosure. FIG. 4 can illustrate a system 400 that can include a media puller device 406 with a snowplow device 402. As described herein, the system 400 can be part of a finisher device that is coupled to an inkjet printing device. In some examples, the media puller device 406 can move partially dried inkjet media to a stacking area to form a stack of partially dried inkjet media.

In some examples, the system 400 can be the same or similar system as system 100 as referenced in FIG. 1, system 200 as referenced in FIG. 2, and/or system 300 as referenced in FIG. 3. For example, the system 400 can include a media puller device 406 coupled to a continuous track 410-1, 410-2 by a number of pegs 428 that are captured in a groove in the front half and a groove in the rear half of the continuous track 410-1, 410-2. The media puller device 406 can be coupled to a timing belt 426 on the continuous track 410-1, 410-2 and moved from a first side to a second side of a finisher via the timing belt 426 rotating on the continuous track 410-1, 410-2.

FIG. 4 can illustrate the media puller device 406 moving around a corner of the continuous track 410-2. As used herein, a corner of the continuous track can be a position of a pulley 424 (e.g., pulley with teeth, etc.) of the continuous track 410-1, 410-2 or a position when the media puller device 406 changes from a first direction to a second direction. For example, the corner of the continuous track 410-2 can be a position when the media puller device 406 changes from moving right to left as illustrated in FIG. 4 to moving left to right as illustrated in FIG. 4. In some examples, a first corner of the continuous track 410-1 can be a position where print media is received from the print zone. In some examples, a second corner of the continuous track 410-1, 410-2 can be a position where print media is stacked (e.g., stacking area, etc.).

In some examples, the media puller device 406 can be coupled to the snowplow device 402 via a first link 404-1 and a second link 404-2. In some examples, the media puller device 406 can be coupled to the second link 404-2 via a rotating joint 418. In some examples, the second link 404-2 can be coupled to the first link via a rotating joint 414. In some examples, the first link 404-1 can be coupled to the snowplow device 402 via a rotating joint 416. In these examples, the system 400 can include a pivot point at each of the rotating joints 418, 414, 416 to more easily wrap around the corner of the continuous track 410-2 and reduce a swept volume of the media puller device 406 and snowplow device 402.

In some examples, the system 400 can include a tension device 408. As described herein, the tension device 408 can be a spring that prevents the snowplow device from over-extending. As illustrated in FIG. 4, the snowplow device can be pushed away from the media puller device 406 by the first link 404-1 and/or the second link 404-2. In some examples, the tension device 408 can prevent the snowplow device 402 from extending beyond a particular swept volume.

In some examples, the system 400 can include a first hard stop 420 to prevent the tension device 408 from being overstretched and a second hard stop 422 to limit motion so tension is maintained by the tension device 408. In some examples, the first hard stop 420 can be positioned on a first link 404-1 to interact with a first side of the snowplow device 402. For example, the first link 404-1 can include a first hard stop 420 to interact with a portion of the snowplow device 402 that is positioned next to a rotating joint 416 that couples the first link 404-1 to the snowplow device 402. In some examples, the second hard stop 422 can be positioned on a second link 404-2 to interact with a second portion of the snowplow device 402. For example, the second link 404-2 can include an extended portion to interact with an interior portion of the snowplow device 402 to provide tension on the tension device 408. For example, the second hard stop 422 can extend toward the snowplow device 402 as the second link 404-2 moves around the corner of the continuous track 410-2. The extension of the second hard stop 422 can provide tension on the tension device 408 as the media puller device 406 and the snowplow device 402 move around the corner of the continuous track 410-2.

In some examples, a tip 430 of the snowplow device 402 is positioned between the front and rear halves of the continuous track 410-1, 410-2 when the media puller device 406 is positioned at a corner of the continuous track 410-2. In some examples, the tip 430 of the snowplow device 402 can be a leading tip of the snow plow device 402. In some examples, the tip 430 of the snowplow device 402 can be shaped and position to pivot such that the tip of the snowplow device 402 does not extend beyond a particular swept volume or exterior portion of the corner of the continuous track 410-2. As illustrated in FIG. 4, the tip 430 can be shaped and positioned such that the tip 430 does not extend beyond the area or profile of the corner of the continuous track 410-2.

The system 400 can provide a snowplow device 402 that can more easily move around corners of a continuous track 410-2 without extending a swept volume of the media puller device 406 when the media puller device 406 moves around a corner of a continuous track 410-2. In some examples, the snowplow device 402 can be coupled to a first link 404-1 and a second link 404-2 that are coupled to the media puller device 406 to provide pivot points that allow the snowplow device 402 to maintain an angle and reduce the swept volume compared to previous devices and systems.

Figure 5:
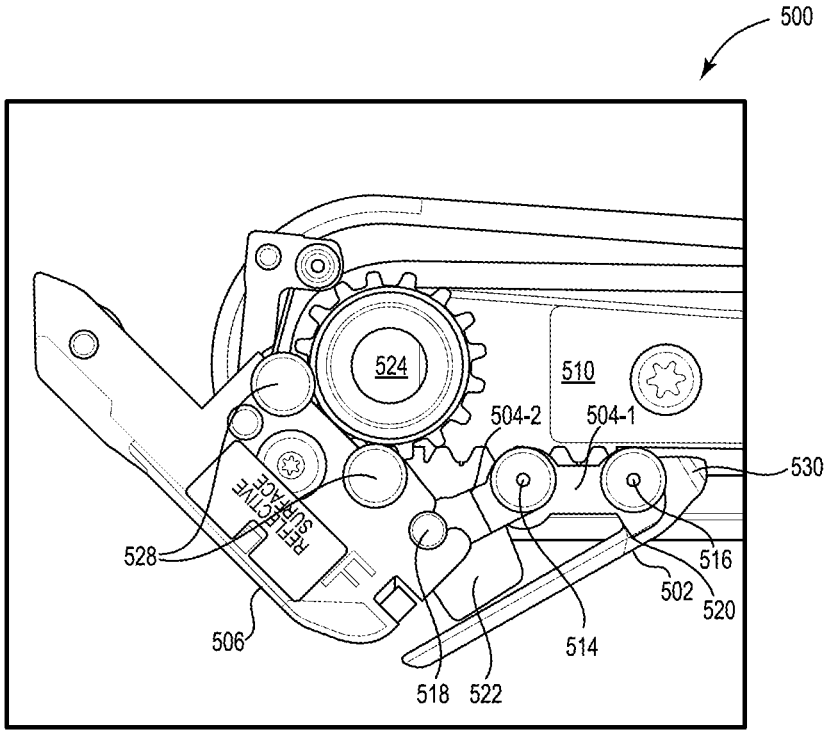
FIG. 5 illustrates an example media puller device consistent with the present disclosure.

FIG. 5 illustrates an example media puller device 506 consistent with the present disclosure. FIG. 5 can illustrate a system 500 that can include a media puller device 506 with a snowplow device 502. As described herein, the system 500 can be part of a finisher device that is coupled to an inkjet printing device. In some examples, the media puller device 506 can move partially dried inkjet media to a stacking area to form a stack of partially dried inkjet media.

In some examples, the system 500 can be the same or similar system as system 100 as referenced in FIG. 1, system 200 as referenced in FIG. 2, system 300 as referenced in FIG. 3, and/or system 400 as illustrated in FIG. 4. For example, the system 500 can include a media puller device 506 coupled to a continuous track 510 by a timing belt 528. The media puller device 506 can be captured in grooves in the two halves of the continuous track 510 and moved from a first side to a second side of a finisher via the timing belt rotating on the continuous track 510 that is coupled to the media puller device 506.

FIG. 5 can illustrate the media puller device 506 moving around a corner of the continuous track 510. As used herein, a corner of the continuous track can be a position of a pulley 524 of the continuous track 510 or a position when the media puller device 506 changes from a first direction to a second direction. In some examples, a first corner of the continuous track 510 can be a position where print media is received from the print zone. In some examples, a second corner of the continuous track 510 can be a position where print media is stacked (e.g., stacking area, etc.). FIG. 5 can illustrate when the media puller device 506 is at the first corner of the finisher device. That is, the media puller device 506 can receive print media at the corner defined by pulley 524.

In some examples, the media puller device 506 can be coupled to the snowplow device 502 via a first link 504-1 and a second link 504-2. In some examples, the media puller device 506 can be coupled to the second link 504-2 via a rotating joint 518. In some examples, the second link 504-2 can be coupled to the first link via a rotating joint 514. In some examples, the first link 504-1 can be coupled to the snowplow device 502 via a rotating joint 516. In these examples, the system 500 can include a pivot point at each of the rotating joints 518, 514, 516 to more easily wrap around the corner of the continuous track 510 and reduce a swept volume of the media puller device 506 and snowplow device 502.

In some examples, the system 500 can include a first hard stop 520 to prevent the tension device from being overstretched and a second hard stop 522 to provide tension on the tension device 508. In some examples, the first hard stop 520 can be positioned on a first link 504-1 to interact with a first side of the snowplow device 502. For example, the first link 504-1 can include a first hard stop 520 to interact with a portion of the snowplow device 502 that is positioned next to a rotating joint 516 that couples the first link 504-1 to the snowplow device 502. In some examples, the second hard stop 522 can be positioned on a second link 504-2 to interact with a second portion of the snowplow device 502. For example, the second link 504-2 can include an extended portion to interact with an interior portion of the snowplow device 502 to provide tension on the tension device. For example, the second hard stop 522 can extend toward the snowplow device 502 as the second link 504-2 moves around the corner of the continuous track 510. The extension of the second hard stop 522 can provide tension on the tension device as the media puller device 506 and the snowplow device 502 move around the corner of the continuous track 510.

In some examples, a tip 530 of the snowplow device 502 is positioned between the front and rear halves of the continuous track 510 when the media puller device 506 is positioned at a corner of the continuous track 510. In some examples, the tip 530 of the snowplow device 502 can be a leading tip of the snow plow device 502. In some examples, the tip 530 of the snowplow device 502 can be shaped and positioned to pivot such that the tip of the snowplow device 502 does not extend beyond a particular swept volume. As illustrated in FIG. 5, the tip 530 can be shaped and positioned such that the tip 530 does not extend beyond the area or profile of the continuous track 510.

The system 500 can provide a snowplow device 502 that can more easily move around corners of a continuous track 510 without extending a swept volume of the media puller device 506 when the media puller device 506 moves around a corner of a continuous track 510. In some examples, the snowplow device 502 can be coupled to a first link 504-1 and a second link 504-2 that are coupled to the media puller device 506 to provide pivot points that allow the snowplow device 502 to maintain an angle and reduce the swept volume compared to previous devices and systems.

Figure 6:
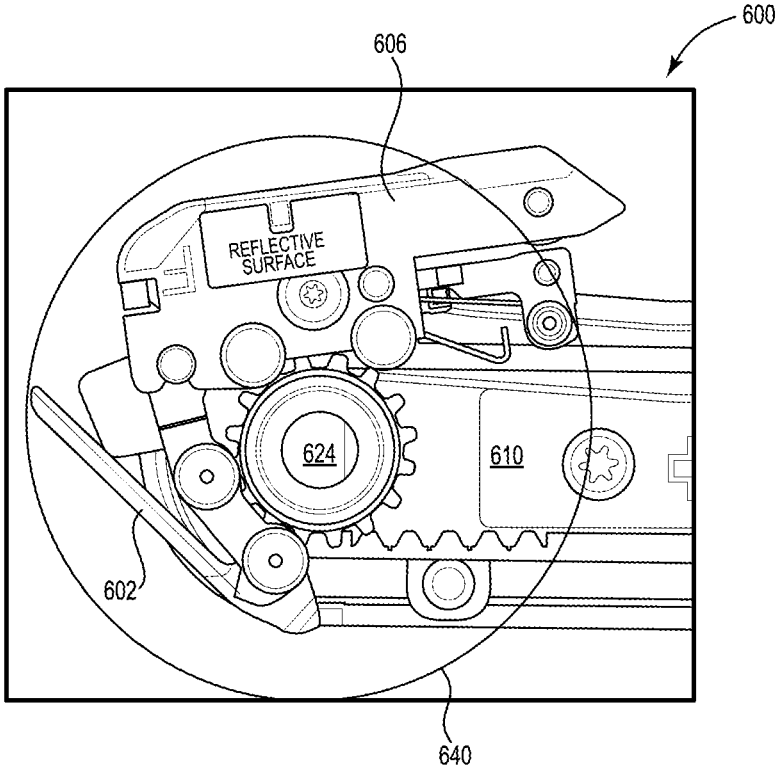
FIG. 6 illustrates an example media puller device consistent with the present disclosure.

FIG. 6 illustrates an example media puller device consistent with the present disclosure. FIG. 6 can illustrate a system 600 that can include a media puller device 606 with a snowplow device 602. As described herein, the system 600 can be part of a finisher device that is coupled to an inkjet printing device. In some examples, the media puller device 606 can move partially dried inkjet media to a stacking area to form a stack of partially dried inkjet media.

In some examples, the system 600 can be the same or similar system as system 100 as referenced in FIG. 1, system 200 as referenced in FIG. 2, system 300 as referenced in FIG. 3, system 400 as illustrated in FIG. 4, and/or system 500 as referenced in FIG. 5. For example, the system 600 can include a media puller device 606 coupled to a continuous track 610 by a number of pegs captured in grooves in the front and rear track halves of the continuous track 610. The media puller device 606 can be moved from a first side to a second side of a finisher via the timing belt rotating on the continuous track 610.

FIG. 6 can illustrate the media puller device 606 moving around a corner of the continuous track 610. As used herein, a corner of the continuous track can be a position of a pulley 624 of the continuous track 610 or a position when the media puller device 606 changes from a first direction to a second direction. For example, the corner of the continuous track 610 can be a position when the media puller device 406 changes from moving right to left as illustrated in FIG. 6 to moving left to right as illustrated in FIG. 6. In some examples, a first corner of the continuous track 610 can be a position where print media is received from the print zone. In some examples, a second corner of the continuous track 610 can be a position where print media is stacked (e.g., stacking area, etc.).

In some examples, an area occupied by the media puller device 606, the plurality of links, and the snowplow device 602 can be a swept volume 640. In some examples, the swept volume 640 can be a particular volume when the media puller device 606 is moving around a corner of the continuous track 610. As illustrated in FIG. 6, the swept volume can be a circle with the pulley 624 positioned at the center of the circle. In some examples, the swept volume 640 is within a usable swept volume for the system 600. As used herein a usable swept volume is an area surrounding the pulley 624 that can be occupied by the media puller device 606 and/or the snowplow device 602 without interacting with other devices or structure of the finisher device.

The system 600 can provide a snowplow device 602 that can more easily move around corners of a continuous track 610 without extending a swept volume 640 of the media puller device 606 when the media puller device 606 moves around a corner of a continuous track 610. In some examples, the snowplow device 602 can be coupled to a first link and a second link that are coupled to the media puller device 606 to provide pivot points that allow the snowplow device 602 to maintain an angle and reduce the swept volume 640 compared to previous devices and systems.

The above specification, examples and data provide a description of the method and applications, and use of the system and method of the present disclosure. Since many examples can be made without departing from the spirit and scope of the system and method of the present disclosure, this specification merely sets forth some of the many possible example configurations and implementations.

What is claimed:

1. A media puller device, comprising:

a clamp to move partially dried inkjet media from an output of a print zone to a stacking area to form a stack of partially dried inkjet media when the clamp releases the partially dried inkjet media at the stacking area;

an angled member coupled to a first end of a hinge, wherein the angled member extends at an angle from the hinge to a point below a leading end of the media puller device to interact with the stack of partially dried inkjet media when the media puller device moves over the stack of partially dried inkjet media;

the leading end of the media puller device coupled to a second end of the hinge; and a tension device to couple the angled member to the media puller device.

2. The media puller device of claim 1, wherein the hinge pivots to maintain the angle of the angled member when the media puller device is positioned at a plurality of locations on a continuous track.

3. The media puller device of claim 1, comprising a first hard stop to prevent the tension device from being overstretched and a second hard stop to provide tension on the tension device.

4. The media puller device of claim 1, wherein the hinge includes a plurality of links coupled together to maintain the angle between the barrier device angled member and a plane of the stack of partially dried inkjet media when the media puller device is positioned over the stack of partially dried inkjet media.

5. The media puller device of claim 1, wherein the angled member is within a swept volume of the media puller device when the media puller device is positioned at a corner of a continuous track, wherein the tension device is to allow the angled member to move away from the leading end of the media puller device to remain within the swept volume of the media puller device.

6. A system, comprising:

a continuous track;

a media puller device coupled to the continuous track, wherein the media puller device includes a clamp to move partially dried inkjet media from an output of a print zone to a stacking area to form a stack of partially dried inkjet media when the clamp releases the partially dried inkjet media at the stacking area;

an angled member coupled to a first link, wherein the angled member extends at an angle from the first link to a point below a leading end of the media puller device to interact with the stack of partially dried inkjet media when the media puller device moves over the stack of partially dried inkjet media;

a leading end of the media puller device coupled to a second link that is coupled to the first link; and a tension device to couple the angled member to the media puller device.

7. The system of claim 6, comprising a hard stop coupled to the second link to maintain a tension on the tension device when the media puller device is positioned at a corner of the continuous track.

8. The system of claim 6, comprising a hard stop coupled to the first link to prevent over-rotation of the angled member.

9. The system of claim 6, wherein the angled member prevents the stack of partially dried inkjet media from being damaged when interacting with the leading end of the media puller device.

10. The system of claim 6, wherein an angle between the angled member and a plane of the stack of partially dried inkjet media is less than 30 degrees when a part of the angled member is positioned over the stack of partially dried inkjet media.

11. The system of claim 6, wherein a tip of the angled member is positioned within a profile of the continuous track when the media puller device is positioned at a corner of the continuous track.

12. A finisher, comprising:

a continuous track to move a media puller device from a first end of the finisher to a second end of the finisher;

the media puller device that includes a clamp to move partially dried inkjet media from an output of a print zone to a stacking area to form a stack of partially dried inkjet media when the clamp releases the partially dried inkjet media at the stacking area; and an angled member coupled to a leading end of the media puller device via a first link and a second link that are connected at a rotating joint, wherein the angled member extends at an angle from the first link to a point below the leading end of the media puller device to interact with the stack of partially dried inkjet media when the media puller device moves over the stack of partially dried inkjet media.

13. The finisher of claim 12, wherein the rotating joint includes a bearing to provide a knuckle between the first link and the second link to allow the angled member to maintain the angle as the angled member and the media puller device move around a corner of the continuous track.

14. The finisher of claim 12, wherein the media puller device delivers the partially dried inkjet media to the stack of partially dried inkjet media positioned below the media puller device.

15. The finisher of claim 12, wherein the rotating joint allows the angled member to rotate around a corner of the continuous track before the media puller device is rotated around the corner of the continuous track.

16. The finisher of claim 12, wherein the first link and the second link provide pivot points to allow the angled member to maintain the angle as the angled member and the media puller device move around a corner of the continuous track.

17. The finisher of claim 12, wherein the angle of the angled member allows the angled member to prevent the leading end of the media puller device from interacting with the stack of partially dried inkjet media.

18. The finisher of claim 12, comprising a tension device to couple the angled member to the leading end of the media puller device, wherein the tension device biases the angled member to a surface of the leading end of the media puller device.

* * * * *